United States Patent [19]

Shelton

[11] 4,256,408

[45] Mar. 17, 1981

[54] DOT MATRIX PRINT HEAD

[75] Inventor: Thomas F. Shelton, Lauderdale Lakes, Fla.

[73] Assignee: International Business Machines Corporation, Armonk, N.Y.

[21] Appl. No.: 62,256

[22] Filed: Jul. 30, 1979

[51] Int. Cl.[3] ..... B41T 3/12

[52] U.S. Cl. ..... 400/124; 101/93.05; 400/692; 400/352

[58] Field of Search ..... 400/118-121, 400/124, 126, 175, 352, 692; 101/93.04, 93.05

[56] References Cited

U.S. PATENT DOCUMENTS

| | | | |
|---|---|---|---|
| 2,973,237 | 2/1961 | Whiteley | 346/140 X |
| 3,960,255 | 6/1976 | Bisson | 400/120 |
| 3,983,803 | 10/1976 | Thomas et al. | 400/59 X |
| 4,059,182 | 11/1977 | Gustafsson et al. | 400/124 |
| 4,134,695 | 1/1979 | Randolph | 400/59 X |

FOREIGN PATENT DOCUMENTS

| | | | |
|---|---|---|---|
| 2248262 | 4/1974 | Fed. Rep. of Germany | 400/124 |

*Primary Examiner*—Paul T. Sewell

*Attorney, Agent, or Firm*—H. W. Barron; J. C. Black

[57] ABSTRACT

There is disclosed herein a dot matrix tilting print head assembly in which the print head is rotatably mounted in a frame. A solenoid is provided for rotating the print head a controlled distance so that printing occurs between previously printed dots. A pin extending from the print head is positioned into a larger diameter hole in the frame for controlling the distance to be one half of the center-to-center distance between printed dots. This entails maintaining very low tolerances for the mechanically moving parts. In addition, there is provided support members for allowing the removal of the print head alone from the frame means.

10 Claims, 13 Drawing Figures

DOT MATRIX PRINT HEAD

The present patent application is one of three copending patent applications which describe the same overall machine configuration but which individually claim different inventive concepts embodied in such overall machine configuration. These three related patent applications were filed on the same date, namely, July 30, 1979, and are more particularly described as follows:

(1) Application Ser. No. 062,259 entitled "Dot Matrix Print Head", the inventors being J. M. Choberka et al (2) Application Ser. No. 062,257 entitled "Dot Matrix Print Head", the inventors being J. M. Choberka et al.

This invention relates to a wire dot matrix printer and more particularly to an improved print head for such a printer.

Wire dot matrix printers are well known in the art. Such printers generally include a wire dot matrix print head mounted on a frame to allow lateral movement of the print head. The printer additionally includes paper handling apparatus to allow either single sheets of paper or continuous paper to be provided around platen means. The print head is adapted to be moved laterally across the paper in either discrete steps or at a constant speed. The print head includes a plurality of thin wires, such as eight. One end of each wire is connected to an actuator which can be energized to cause the wire to move forward. The other ends of the wires are aligned in a vertical straight line close to the platen. Ribbon means are inserted between the ends of the wires and the paper so that when an actuator is energized, a wire moves forward and strikes the ribbon against the paper, leaving a dot on the paper. By appropriate lateral movement of the print head and selective energizing of the solenoids, characters can be printed on the wire in a well known manner. One example of such a wire dot matrix print head is shown in U.S. Pat. No. 3,897,865, invented by Daniel P. Darwin et al and entitled "Dot Printing Apparatus" and means to control that print head to print alphanumeric characters shown in U.S. Pat. No. 4,096,578, invented by Charles D. Malkemes, entitled "Data System With Microprocessor Featuring Multiplexed Data Transfer and Repeat Cycle Driving Arrangement". Also, U.S. Pat. No. 3,987,883 invented by Daniel P. Darwin et al entitled "Ribbon Lifting Mechanism For A Wire Matrix Printer" shows the mounting of the print head in the printer.

Each of these patents are commonly assigned to the assignee of the present invention.

One of the problems of the prior art wire dot matrix printers is the quality of the characters printed. Because the wires of the printers must be physically separated from one another to avoid the wear and tear due to the wire rubbing against one another, the printed dots also are separated. While the printed dots tend to blend together somewhat, the character still does not have the quality of a similar character printed by engraved print element type printers, such as typewriters. This is especially true for characters with non-vertical or non-horizontal lines, such as the letters A or X.

One solution to the character quality problem is to use a dot matrix printer in which multiple passes of the print head over the same line occur in a manner to cause dots to be printed between previously printed dots. In this manner, there are no open spaces between the dots. One printer which shows apparatus to print between previously printed dots is described in U.S. patent application Ser. No. 034,831 in the name of J. E. Lisinski et al, entitled "Tilting Print Head" and assigned to the assignee of the present invention. In this printer, the print wires are caused to move a distance equivalent to one-half the center-to-center spacing between the previously printed dots so that on a second pass across the line, printing occurs between the dots. In addition, the speed of the printer is cut by one-half, that is, the horizontal distance between dots is cut in half so that printed dots overlap one another. It would also be possible to achieve the same results by moving the platen an amount equal to one-half of the center-to-center distance between printed dots and passing the print head over the line both before and after the small platen movement. Also, rather than slowing the movement of the print head across the paper by one-half, one could cause additional passes of the print head across the paper and print in alternate available locations on each pass so as to effectively cause the horizontally positioned dots to be overlapped.

In the above noted patent application Ser. No. 034,831, in which a tilting print head is utilized to cause printing to occur between vertically positioned dots, the print head is rotatably mounted in a yoke or carrier and a solenoid is energized to rotate the print head. Stop means are provided to control the amount of rotation to position the print wires after rotation in a proper orientation to print between previously printed dots.

One of the problems with the idea of providing a tilting print head becomes allowable tolerances. Because the center-to-center spacing between print wires is approximately 0.015 inches, it is necessary to move the end of the print head 0.0075 inches with a tolerance of plus or minus 0.0005 inches. With this very slight movement, very tight tolerances are required for the mechanical parts controlling the movement. Two critical areas for tolerances are the point of rotation and the stop means. The axis of rotation must remain fixed. Thus, it is not practical to use a conventional pivoting arrangement in which a cylindrical pivot post is inserted into a cylindrical hole since achieving rotation requires the hole to be bigger than the post. This difference in size would result in too great an axis movement to allow the small but accurate movement required of the print wires. The second area where little or no tolerance is available is in the stop means. Since the stop means must be closely controlled to have minimum tolerances, it must be a machineable part. Also, the repeated movement of the print head against the stop means causes the stop means to require replacement periodically due to the wear and tear created.

Another problem apparent in wire matrix printers is the ability to remove the print head from the apparatus holding the print head in place on the printer. After much use, the print head will become unuseable due to, for instance, one of the print wires breaking and the entire head will have to be replaced. In the prior art mountings of the print head, such as shown in the aforementioned U.S. Pat. No. 3,987,833, means are shown for affixing a print head to a yoke. If the print head itself needs to be replaced, it is necessary to remove the entire assembly including the yoke. It would be preferable if means were provided for easily removing the print head alone and replacing it, thereby saving the cost of replacing the yoke. In accordance with one aspect of this invention, there is provided apparatus for removably mounting a dot matrix print head in yoke means comprising at least one support member and hole means in the yoke means through which the support member is movably positioned. In addition, there is provided a pair of receiving means in the print head for receiving opposite ends of the support member to mount the print head to the yoke means and spring means within one of the receiving means for maintaining one end of the support member removed back the back of that one receiving means and for being compressed to allow the other end of the support member to be removed from the other of that pair of receiving means.

One preferred embodiment of the present invention will hereafter be described with particular reference being made to the following figures, in which.

Figure 1:
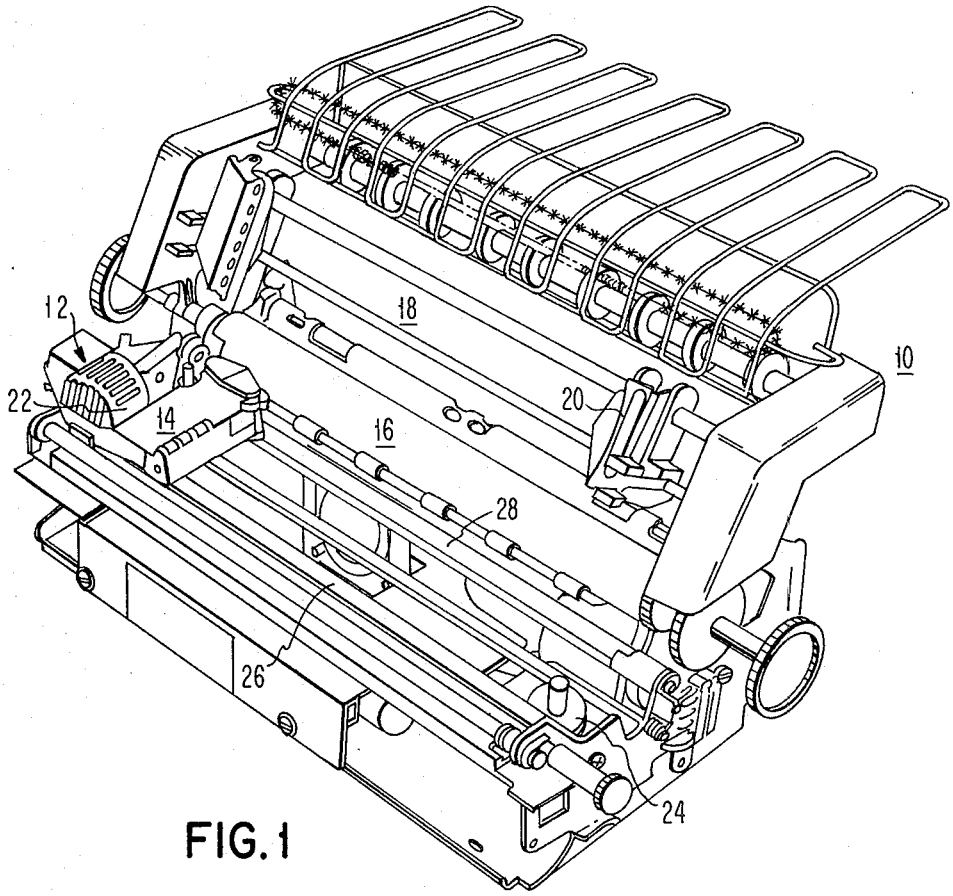
FIG. 1 is an isometric view of a wire dot matrix printer utilizing the improved print head of the subject invention.

Referring now to FIG. 1, there is shown an isometric diagram of a printer 10 having the improved print head assembly 12. Printer 10 includes a ribbon holder 14 for supplying ribbon around the front of print head assembly 12. In addition, printer 10 includes a platen 16 positioned on the side of the ribbon provided from ribbon holder 14 opposite the print head assembly 12.

Printer 10 further includes a forms feed system 18 including a pair of tractors 20 for feeding paper or other record medium around platen 16 and in front of print head assembly 12 to allow characters to be printed on the paper. The record medium may be continuous computer paper having perforated edges which are pulled through forms feed system 18 by tractors 20 or the paper may be individual sheets which are inserted behind platen 16 and fed by pressure rollers as platen 15 rotates. The movement of the paper through forms feed system 18 is controlled by stepper motors (not shown) which respond to electrical signals.

Characters are printed on the paper by actuating one or more of the wires in print head assembly 12 to cause them to move forward striking the ribbon against the paper which is held firm by platen 16. Thereafter, the wire is deactuated and returns to its initial position, leaving a dot on the paper. Print head assembly 12 moves from the left margin position, shown in FIG. 1, towards the right and the wires are actuated to cause dots to be printed adjacent to one another. In this manner characters are formed on the paper inserted around platen 16. Print head assembly 12 includes eight narrow wires arranged in a vertical row on the end of print head assembly 12 closest to platen 16. The upper seven wires in the vertical row are utilized to print the characters with the bottom wire is utilized for underscoring. The other end of the wires are connected to eight individual actuators connected around a circle. The actuators of print head assembly 12 are covered by cover 22. A detailed description of the construction of print head assembly 12 is given in the aforementioned U.S. Pat. Nos. 3,897,865 and 3,987,883, the disclosure of which is hereby incorporated by reference.

Print head assembly 12 is moved from left to right and right to left along platen 16 by a stepper motor (not shown) connected to spindle and belt assembly 24. Print head assembly 12 rides along a pair of shafts 26 and 28 as it is moved across platen 16.

Figure 2:
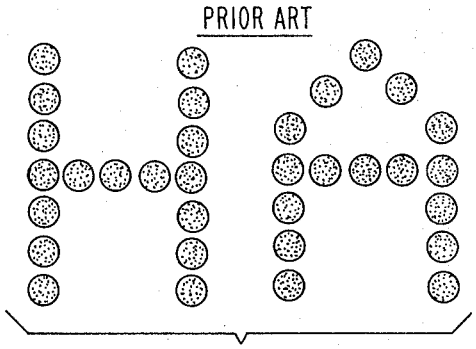
FIG. 2 is the letters H and A printed with a prior art dot matrix printer.

In the prior art, as print head assembly 12 moves from the left margin position, as shown in FIG. 1, towards the right, a single line of characters is printed. Thereafter platen 16 is rotated moving the paper forward one line space and print head assembly 12 moves from right to left or back towards the position shown in FIG. 1. During this right to left movement, a second line of characters is printed on the paper. In this manner, the printed characters look like those shown in FIG. 2. Since the wires must be physically separated from one another in order to avoid wear and tear, the printed dots are also separated from one another. The horizontal spacing between the dots such as in the cross bar of the letters H and the A shown in FIG. 2 is determined by the speed of print head assembly 12 as it moves laterally across platen 16 in conjunction with the rate at which the actuators are energized to cause the wires to move forward and print the dots. It should be noted that the distance between the dots becomes particularly far apart in the case of slanted lines such as in the upper portion of the letter A as shown in FIG. 2 and in printed documents, this dot spacing can be readily observed.

Figure 3:
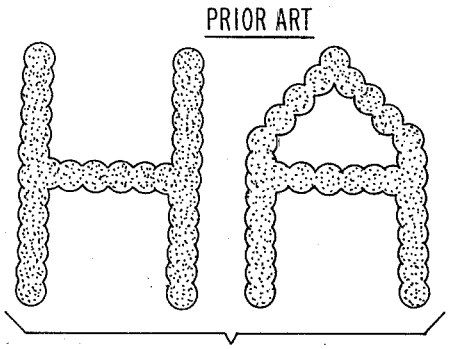
FIG. 3 is the letters H and A printed with the dot matrix printer of the subject invention.

In the aforementioned co-pending patent application Ser. No. 034,831, means are shown for causing the characters to be printed on the left to right pass of print head assembly 12 over platen 16 in a manner similar to the prior art. However, the speed print head 12 moves is reduced by 50% and on the right to left pass, print head assembly 12 is tilted so that printing occurs between the vertical dots and the printed characters appears as shown in FIG. 3. From FIG. 3 it is seen that the characters are more solidly shaped and appear much closer to the type of character printed with an engraved printing element such as typewriter.

Figure 4:
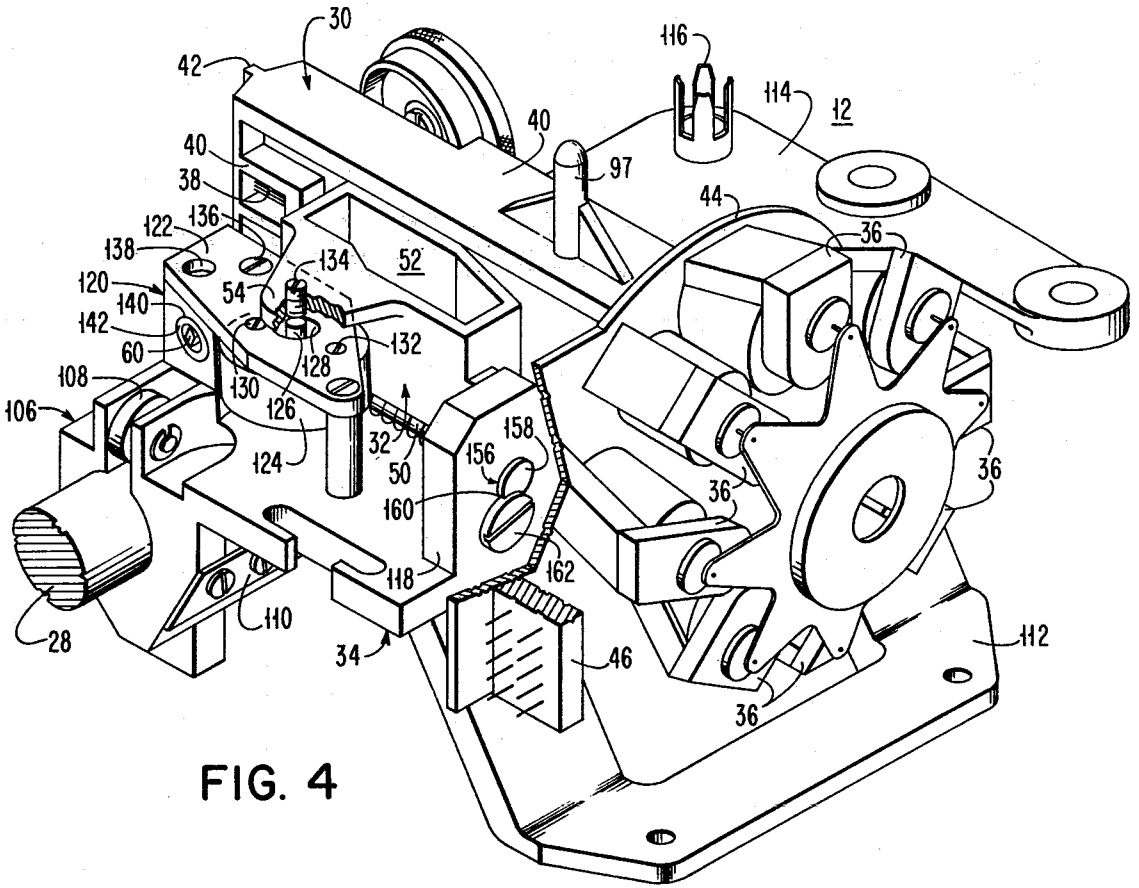
FIG. 4 is an isometric view of the print head portion of the printer shown in FIG. 1.
Figure 5:
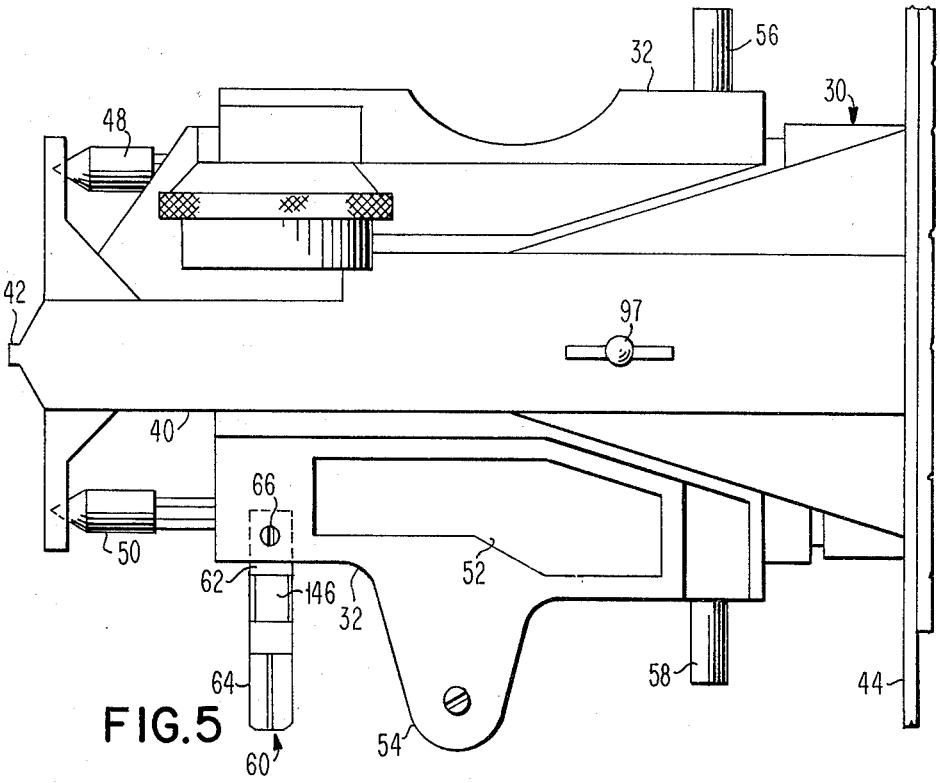
FIG. 5 is a top view of the print head and yoke shown in FIG. 4.
Figure 6:
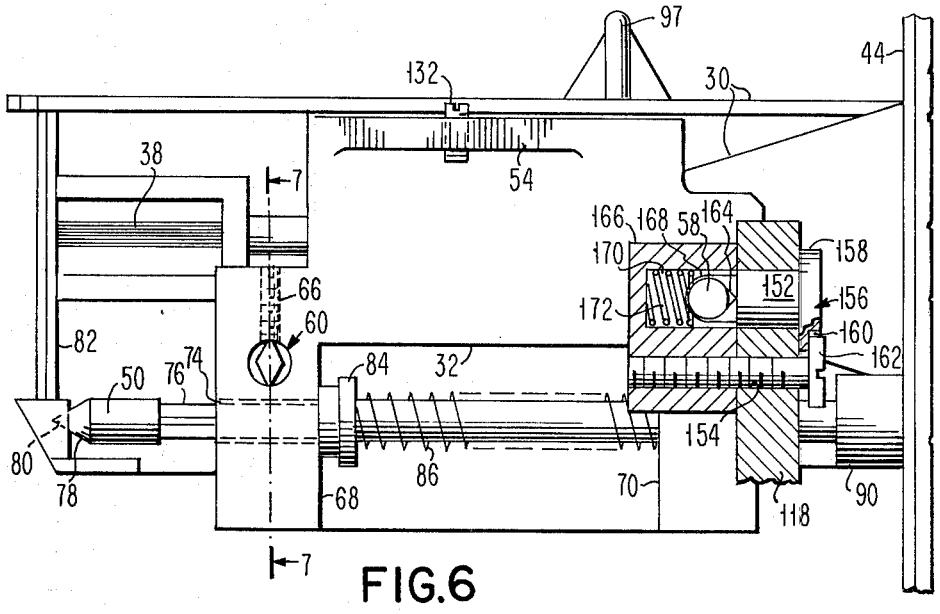
FIG. 6 is a side view of the print head assembly shown in FIG. 4 with the pivot holder included in partial cut-away.

It should be noted that by reducing the print head speed across platen 16 by approximately 50%, the horizontal dots are printed between the prior art horizontal dots. Referring now to FIGS. 4, 5 and 6, print head assembly 12 is shown. Print head assembly 12 includes a print head 30, such as the one shown in the aforementioned U.S. Pat. No. 3,897,865, pivotably coupled to a yoke 32. Print head 30 and yoke 32 are shown from an isometric view in FIG. 4, a top view in FIG. 5 and a side view in FIG. 6.

Print head 30 includes eight actuators 36 which may be of the type described in the aforementioned U.S. Pat. No. 3,897,865. Each of the actuators 36, which drive an individual wire element 38, are arranged around the circumference of the circle at the back of print head 30. The wires 38 are guided through a housing 40 of print head 30 and arrive at the front end 42 of print head 30 in a vertical alignment. Each of the wires 38 must be physically separated from the other wires 38 at all points. This is necessary for preventing undue wear and tear to occur on the wires as a result of their rubbing against one another. Between the actuators 36 and the housing 40 of print head 30 is a printed circuit board 44 in which printed wires connect each of the actuators 36 to the connector 46.

Print head 30 is connected to yoke 32 by a pair of support members 48 and 50 in a manner which will be described hereafter. Yoke 32 includes oil reservoir 52 having an extension plate 54 extending from the top thereof. Yoke 32 also has a pair of cylindrical pivot pins 56 and 58 extending from the sides thereof. In addition, a pin 60 having a cylindrical portion 62 and a diamond shaped portion 64 is secured into yoke 32 by a set screw 66. The diamond shaped portion 64 of pin 60 has a vertical axis parallel to the alignment of wires 38 at front end 42, which is longer than its horizontal axis.

Referring now to FIGS. 7, 8, 9 and 10, the manner in which print head 30 is attached to yoke 32 using support members 48 and 50 will now be described. Yoke 32 has four legs, three of which, 68, 70 and 72 are shown in the Figs. Legs 68 and 70 are side legs on the left side when facing the direction the wires are actuated and legs 72 and the unseen leg, which is similar to leg 70, are the two right side legs of yoke 32; legs 68 and 72 are the front two legs, and legs 70 and the unseen leg are the back two legs. Each of the legs 68, 70 and 72 has a hole 74 therethrough. The two support members 48 and 50 are inserted through the holes 74 of the side legs, as seen by support member 50 being inserted through the holes 74 of legs 68 and 70 in FIGS. 8, 9 and 10. Support members 48 and 50 are identical, with one exception. Generally each of the support members are cylindrical in shape with the exception being that only for support member 50 the portion 76 thereof through hole 74 of leg 68 is diamond shaped with the longer vertical axis being parallel to the line of wires 38. The purpose or providing diamond shaped portion 76 is to minimize the alignment problems when manufacturing yoke 32. With the shorter horizontal axis of diamond portion 76, support members 48 and 50 may be positioned through the holes in front legs 68 and 72 with a substantial amount of lateral tolerance relative to the tolerance which would be available if diamond shaped portion 76 were cylindrical. The lateral tolerance of print head assembly 12 is not as critical as the vertical tolerance thereof, since print head assembly 12 rotates such a small vertical distance of one half the center-to-center distance between adjacent printed dots.

Figure 8:
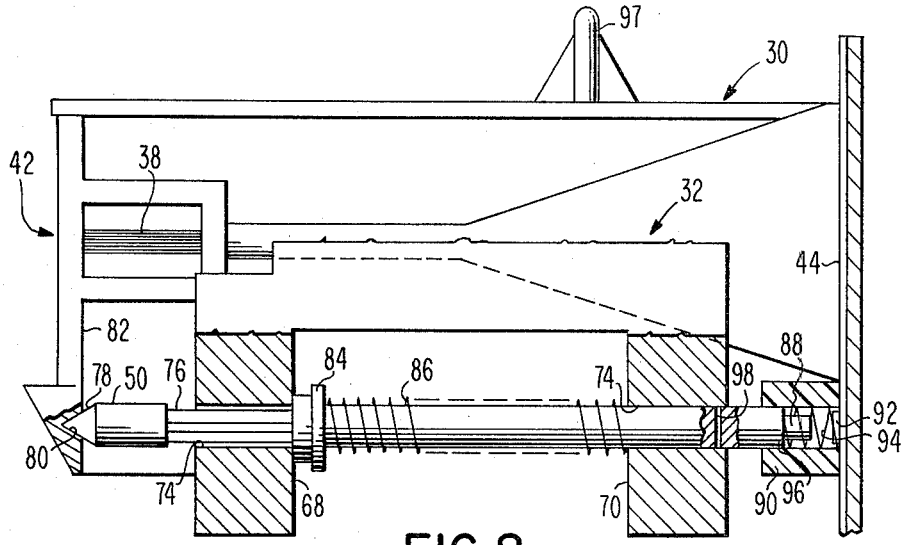
FIGS. 8, 9 and 10 show a side view partially in cut-away of the manner in which the print head is mounted to the yoke and may be disconnected therefrom.
Figure 9:
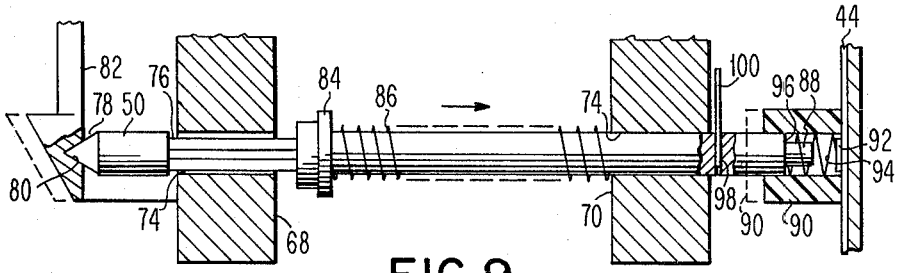
Figure 10:
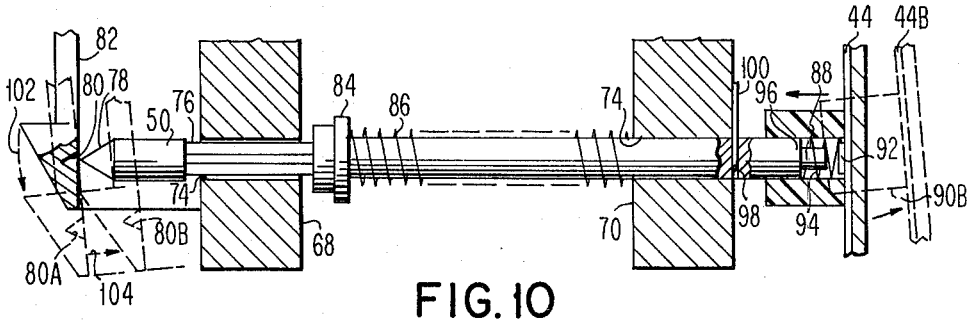

Each of support members 48 and 50 include a conical shaped front edge 78 adapted to receive a conical indentation 80. Indentation 80 is a part of and attached to housing 40 by an arm 82 extending from housing 40. The portion of support member 48 and 50 between the holes 74 of the side legs such as 68 and 70 as shown in FIGS. 8–10, includes a stop 84 and a spring 86 positioned between the back legs, such as 70, and the stop 84. Stop 84 is positioned on support members 48 and 50 such that when print head 30 is mounted in yoke 32, stop 84 is juxtaposed with the front legs 68 and 72 due to the force applied by spring 86. The back of support members 48 and 50 is a cylinder 88 having a smaller diameter than the main portion of support members 48 and 50 but otherwise integrally attached thereto. The back side of support members 48 and 50 are inserted into a hole in rear receiving portion 90 coupled to circuit board 44 which itself is coupled to housing 40. An insulator 92 is provided at the back of the hole in receiving portion 90 to insulate the printed wiring on circuit board 44 from support members 48 and 50. Support members 48 and 50 are inserted into receiver 90 against a spring 94. The length of support members 48 and 50 is less than the distance between the back of the holes in indentation 80 and portion 90, so that spring 94, when positioned between insulator 92 and the back 96 of the main portion of members 48 and 50, provides a force against housing 40 holding the conical front end 78 in the hole 80.

Each of support members 48 and 50 additionally has a hole 98 through the center thereof. Hole 98 is positioned such that it is within the hole 74 of rear legs of yoke 32 such as rear legs 70 when support members 48 and 50 are inserted firmly into hole 80 and spring 86 is extended as far as possible. Hole 98 can be exposed by moving print head 30 and support members 48 and 50 backwards with respect to yoke 32, thereby further compressing spring 86. This may be easily done by using handle 97.

The removal of print head 30 from yoke 32 will now be described. Removing print head 30 takes advantage of the fact that spring 86 forces support member 48 and 50 forward towards front end 42 while spring 94 pushes housing 40 backward, thereby maintaining hole 80 inserted against the conical front ends of 78 of support members 48 and 50, as shown in FIG. 8. In order to remove print head 30 from yoke 32, the first step is to push back print head 30 and support members 48 and 50 while maintaining yoke 32 stationary to a position shown in FIG. 9. This compresses spring 86 and exposes hole 98. Next a pin member 100, which may be a paper clip, bobby pin or a special tool, is inserted in hole 98. Then the housing 40 and support members 48 and 50 are allowed to move forward due to the forces exerted by spring 86 to a position in which the pin member 100 is against the back legs 70 of yoke 32. Next, as shown by FIG. 10, housing 40 is then pushed forward while support members 48 and 50 are held stationary due to pin 100 being against the back legs 70 by an amount sufficient to remove the conical end 78 from indentation 80. This is the position shown by the solid lines in FIG. 10. During this movement, spring 94 is compressed and the back end 88 of support members 48 and 50 moves towards insulator 92 in the rear receiving portion 90. Thereafter, the entire housing is moved downward as indicated by arrow 102 so that hole 80 is in the position shown by the reference number 80A. Then spring 94 is allowed to return to its normal state, thereby moving the housing in the direction indicated by arrow 104, so that the indentation 80 is in the position shown by the reference number 80B. At this point, support members 48 and 50 have been disengaged from rear receiving portion 90 which now is in the position indicated by the reference number 90B and print head 32 may be removed by lifting the back end of housing 40 upward and out of yoke 32, while slipping the extension 82 from under support members 48 and 50.

Referring now to FIG. 4, frame 34 will now be described. Print head 30 and yoke 32 as coupled together by support members 48 and 50 in the manner previously described are pivotably connected to frame 34. Frame 34 includes on its front end shaft receiving means 106 for slidably being mounted on shaft 28. Mechanism 106 includes bearing 108 and support 110 for a second bearing (not shown) positioned beneath frame 34. A third bearing similar to bearing 108 is also included on the side of mechanism 106 hidden by shaft 28. Bearings similar to bearing 108 and hidden bearing appear on the other side of frame 34 as well. Frame 34 also includes second shaft mounting means 112 for mounting on shaft 26 in a known manner.

On the right side of frame 34, ribbon mounting mechanism 114 is shown and includes a spindle 116 adapted to be placed into the ribbon holder 14. Ribbon (not shown) is fed from ribbon holder 14 around the front end 42 of print head 30 back to the back of ribbon holder 14 in a known manner.

Frame 34 includes a pivot receiver portion 118 on both sides of print head 30. For simplicity, only one of the pivot receiver portions 118 is shown, it being understood that a similar portion exists on the opposite side of print head 30.

Referring now to FIG. 6, the manner in which yoke 32 is rotatably connected to frame 34 will now be described. As previously mentioned, this connection is pivotable, that is, yoke 32 pivots around pins 56 and 58 extending therefrom. The pivot receiver portion 118 of frame 34 has a pair of holes 152 and 154 therethrough. Pivot receiving means 156 is inserted through hole 152. Pivot receiving means 156 has a large head 158 having a notch 160 cut out from the bottom thereof. Notch 160 has a shape adapted to receive the head of screw 162 which is inserted in hole 154. The other side of pivot receiving means 156 has a V notch 164. V notch 164 and notch 160 in head 158 are aligned such that when the head of screw 162 is in notch 160, V notch 164 is positioned to have post 58 from yoke 32 inserted thereagainst.

Pivot holder 166 is secured against pivot receiver portion 118 by screw 162. Pivot holder 166 has a horizontal U shaped indentation 168 thereacross in a direction perpendicular to the view shown in FIG. 6. The diameter of the circular portion of the U shaped indentation 168 is slightly larger than the diameter of post 58 so that post 58 fits into the U shaped indentation 168. Positioned in alignment with pivot receiving means 156 when pivot holder 166 is secured by screw 162 is a hole 170 adapted to have a spring 172 inserted therein. Spring 172 is under compression when pivot holder 166 is secured by screw 162 so that it applies a force against post 58 causing it to be securely held against V notch 164.

Although not shown, it should be understood that identical structure including pivot receiver portion 118, pivot receiving means 156, screw 162 and pivot holder 166 are positioned on the opposite side of frame 34 to receive post 56 in the same manner that post 58 is received. Coupled in this manner yoke 32 is free to rotate about an axis through posts 56 and 58. The advantage to utilizing the structure shown over more conventional structure of a hole to receive post 56 and 58 is that first less friction is present against posts 56 and 58 rotating in the V notch than would be in a cylindrical hole and, second, and more important, the alignment problems are diminished because it is not critical as to which part of the V shaped notch 164 that the posts 56 and 58 are positioned inasmuch as only two surface junctions will be present.

Frame 34 also includes distance control means 120 extending therefrom which only is positioned on the left side, as shown in FIG. 4. Plate 122 is secured to distance control means 120 and extends out from means 120. The height of means 120 and plate 122 is selected to be such that the top of plate 122 fits beneath extension plate 54 from yoke 32. A solenoid 124 is secured to the bottom of plate 122 and the piston portion 126 of solenoid of 124 extends through a hole 128 in plate 122. Solenoid 124 secured to the bottom of plate 122 by screws 130 and 132. A set screw 134 is secured into extension plate 54 in alignment with the position that piston 126 strikes plate 154. Set screw 134 is adjusted to just touch piston 126 when solenoid 124 is not energized.

Figure 7:
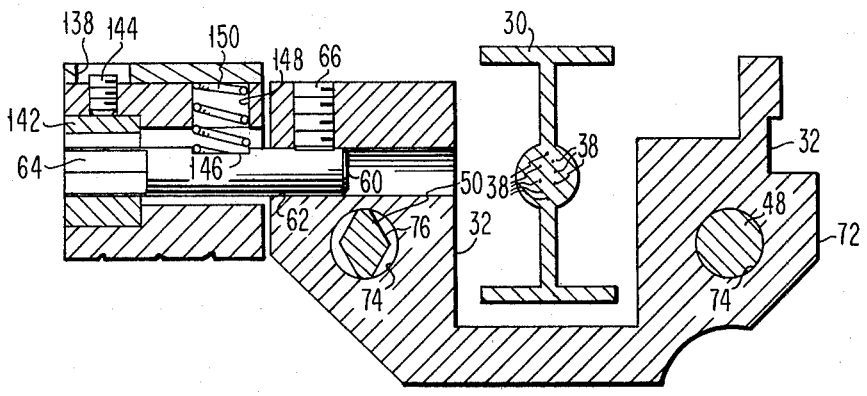
FIG. 7 is a cut-away view taken across lines 7—7 of FIG. 6.

Plate 122 is secured to means 120 by a screw 136. In addition, plate 122 has a hole 138 vertically therethrough and means 120 has a hole horizontally through it and aligned to receive pin 60 from yoke 32. Hole 140 has a bushing 142 inserted therein and held by a set screw 144 positioned within hole 138. The length of bushing 142 and the length of the diamond portion of pin 60 are approximately the same so that the diamond portion 64 of pin 60 is free to move within bushing 142. The inner diameter of 142 is slightly bigger than the longer diameter of the diamond portion 64 of pin 60. Pin 60 also has a flat portion 146 aligned with a hole 148 in means 120. A spring 150 is positioned in hole 148 and held compressed against flat portion 146 by plate 122 being secured to means 120. In this manner, pin 60 is held in the normal down position, as shown in FIG. 7.

Figure 11:
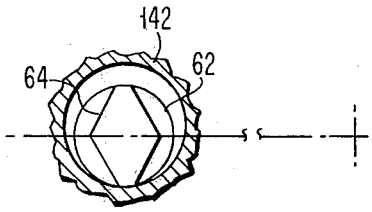
FIGS. 11 and 12 show a detailed view how the stop means controls the amount of rotation of the print head shown in FIG. 4.
Figure 12:
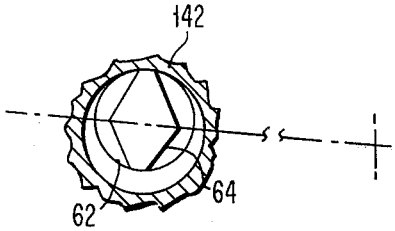

The amount of rotation of yoke 32 within frame 34 is controlled by the movement of the diamond portion 64 of pin 60 in bushing 142. This is shown in detail in FIGS. 7, 11 and 12 to which reference is now made. When solenoid 124 is not energized, spring 150 exerts force against the flat portion 146 of pin 60 causing the bottom of diamond portion 64 to rest against the inside bottom of bushing 142. This is the position shown in FIG. 7 and in exploded front view, shown in FIG. 11. When solenoid 124 is energized, the force provided thereby against extension plate 54 is greater than the force provided by spring 150 against pin 60. Hence, extension plate 54 is moved upward and carries with it the entire yoke 32 including pin 60. This movement is abruptly stopped when the top of diamond portion 64 touches the inside top of bushing 142, as shown in FIG. 12. The difference between the inner diameter of bushing 142 and the longer axis of the diamond shaped portion 64 of pin 60 can be selected to control the movement of print wires 38 to be one-half of the center-to-center distance separating the wires or, in other words, one-half of the center-to-center distance between the printed dots. This difference between the inner diameter of bushing 142 and the longer vertical axis of diamond portion 64 of pin 60 can be easily determined by using the ratio that the distance from the axis of rotation around pins 56 and 58 to front end 42 compared to the distance from that axis of rotation to pin 60 is equal to the ratio of the desired movement of wires 38 compared to the difference between the inner diameter of bushing 142 and the longer vertical axis of diamond portion 64.

Figure 13:
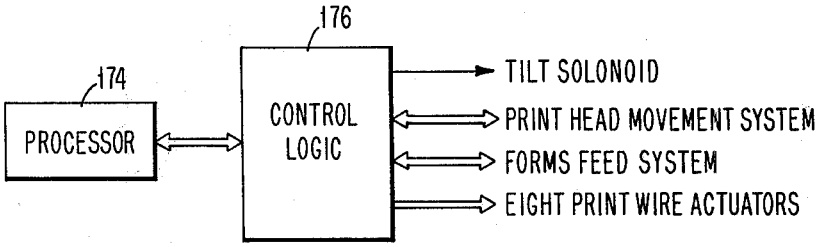
FIG. 13 is a block diagram of the electrical system controlling the printer shown in FIG. 1.

Referring now to FIG. 13, a block diagram of the control circuitry for printer 10 is shown. Printer 10 may be utilized with a processor system 174 which provides signals to control logic 176 to cause a line of characters to be printed. Control logic 176 stores the characters to be printed and provides signals to control tilt solenoid 124, to control the lateral movement of print head assembly 12, to control the movement of paper by the forms feed system 18 and to fire the eight print wire actuators 36. A more detailed description of such a control system, with the exception of the control of the tilt solenoid 124, is described in the aforementioned U.S.

Pat. No. 4,096,578. Controlling the tilt solenoid requires setting a latch at the end or right point of the left to right movement and maintaining that latch set for the entire right to left movement. The output of the latch may be coupled through appropriate driver circuits to control solenoid 124.

What is claimed is:

1. Apparatus for removably mounting a dot matrix print heaad in yoke means comprising:

at least one support member having means adapted to receive engagement means which is to be held in a stationary position against said yoke means;

hole means in said yoke means through which said support member is movably positioned;

a pair of receiving means in said print head for receiving opposite ends of said support member to mount said print head to said yoke means; and spring means within one of said receiving means for maintaining one end of said support member removed from the back of that one receiving means and for being compressed to allow the other end of said support member to be removed from the other of that pair of receiving means whenever said engagement means is held in said stationary position.

2. The invention according to claim 1 wherein said spring means is compressed by movement of said print head against said support member while said support member is held stationary against said yoke means.

3. The invention according to claim 2 wherein said apparatus further comprises means for urging said support member forward into said other receiving means.

4. The invention according to claim 1 wherein said means adapted to being held includes a hole in said support member.

5. The invention according to claim 4:

wherein said apparatus further comprises second spring means and stop means affixed to said support member, said second spring means being positioned between said stop means and said yoke means; and wherein said hole in said support member is exposed when said spring means is compresssed, said hole in said support means being adapted to receive pin means to be held against said yoke means upon release of said spring means.

6. Apparatus for removably holding a dot matrix print head comprising yoke means having first and second holes;

a pair of support members each having two ends separated by a given distance and each positioned through an associated yoke means hole, each of said support members having means adapted to receiving holding means to hold that support member stationary against said yoke means;

two pair of first and second receiving means each positioned on said yoke means, each pair of receiving means being associated with and engaging a support member, each receiving means having a front and a back, the distance between the front of one and the back of the other receiving means of each pair of receiving means being greater than said given distance and the distance between the back of said one and the front of said other receiving means of each pair of receiving means being less than said given distance; and spring means, positioned within each second receiving means between one end of said support member and the back of that receiving means, for being compressed by movement of said print head against said support member while said support member is held stationary against said yoke means to allow the other end of said support members to become disengaged from said first receiving means.

7. The invention according to claim 6 wherein said support members are slideable through said yoke means holes.

8. The invention according to claim 7 wherein said means adapted to receiving said holding means includes a hole in said support member adapted to receive a pin, said support member hole being normally hidden within the yoke means hole, and being exposed as said support member slides through said yoke means holes.

9. The invention according to claim 8 wherein said support member includes stop means and second spring means between said stop means and said yoke means hole for urging said support member forward.

10. The invention acocrding to claim 9 wherein the side of said stop means remote from said spring means is positioned against said yoke means to stop the forward movement of said support means beyond a desired position.

* * * * *